US005095311A

United States Patent [19]

Sajiki et al.

[11] Patent Number: 5,095,311

[45] Date of Patent: Mar. 10, 1992

[54] ELECTROMAGNETIC WAVE ABSORBING ELEMENT

[75] Inventors: Takashi Sajiki; Yasuharu Nagatomo; Shoji Yokokoji; Moriyoshi Kurosawa, all of Tokyo, Japan

[73] Assignee: Toppan Printing Co., Ltd., Japan

[21] Appl. No.: 276,225

[22] Filed: Nov. 23, 1988

[30] Foreign Application Priority Data

Nov. 28, 1987 [JP] Japan ..... 62-181650
Jun. 1, 1988 [JP] Japan ..... 63-134969

[51] Int. Cl.[5] ..... H01Q 17/00
[52] U.S. Cl. ..... 342/1; 342/4
[58] Field of Search ..... 342/1-4

[56] References Cited

U.S. PATENT DOCUMENTS

| | | | |
|---|---|---|---|
| 2,771,602 | 11/1956 | Kühnhold | 342/1 |
| 2,828,484 | 3/1958 | Skellett | 342/1 |
| 2,985,880 | 5/1961 | McMillan | 342/4 X |
| 3,124,798 | 3/1964 | Zinke | 342/4 |
| 3,234,549 | 2/1966 | McMillan | 342/4 |
| 3,315,259 | 4/1967 | Wesch | 342/3 |
| 3,315,261 | 4/1967 | Wesch | 342/4 |
| 3,440,655 | 4/1969 | Wesch et al. | 342/1 |
| 3,441,933 | 4/1969 | Tuinila et al. | 342/4 |
| 3,453,620 | 7/1969 | Fleming et al. | 342/4 |
| 3,509,568 | 4/1970 | Manning et al. | 342/2 |
| 3,521,201 | 7/1970 | Veteran | 333/81 R |
| 3,596,270 | 7/1971 | Fukui | 342/1 |
| 3,721,982 | 3/1973 | Wesch | 342/1 |
| 3,806,928 | 4/1974 | Costanza | 342/4 |
| 3,887,920 | 6/1975 | Wright et al. | 342/1 |
| 4,012,738 | 3/1977 | Wright | 342/1 |
| 4,118,704 | 10/1978 | Ishino et al. | 342/4 |
| 4,162,496 | 7/1979 | Downen et al. | 342/4 |
| 4,170,010 | 10/1979 | Reed | 342/1 |
| 4,327,364 | 4/1982 | Moore | 342/1 |
| 4,531,128 | 7/1985 | Mensa et al. | 342/7 |

FOREIGN PATENT DOCUMENTS

| | | |
|---|---|---|
| 0121655 | 10/1984 | European Pat. Off. . |
| 1244254 | 7/1967 | Fed. Rep. of Germany . |
| 417706 | 7/1966 | Switzerland . |
| 969141 | 9/1964 | United Kingdom . |
| 969142 | 9/1964 | United Kingdom . |

OTHER PUBLICATIONS

Patent Abstracts of Japan, vol. 9, No. 10 (E-290) [1733], Jan. 17, 1985, Mitsubishi Denki KK.

*Primary Examiner*—John B. Sotomayor
*Attorney, Agent, or Firm*—Bruce L. Adams; Van C. Wilks

[57] ABSTRACT

An electromagnetic absorbing element is comprised of an elongated rectangular body of dielectric material having a bottom portion attachable to an inner wall of an electromagnetically dark room, and peripheral elongated faces extending vertically from the bottom portion such that a set of the absorbing elements can be arranged in rows-and-columns on the wall. An electroconductive ink film is formed on the peripheral faces of body and has a gradually changing surface resistivity decreasing exponentially lengthwise of the peripheral face toward the bottom portion. The incident electromagnetic wave normal to the wall provided with the rows-and-columns of absorbing elements is absorbed by a lattice of the electroconductive films during the travel along the electroconductive films.

17 Claims, 2 Drawing Sheets

ELECTROMAGNETIC WAVE ABSORBING ELEMENT

BACKGROUND OF THE INVENTION

1. Field of the Invention

The present invention relates to electromagnetic wave absorbing elements arranged on interior surfaces of a housing to constitute an electromagnetically dark room.

2. Prior Art

It is well known that a plurality of electroconductive film elements are arranged in parallel crosses on a wall so as to absorb electromagnetic wave energy incident normal to the wall to thereby suppress the transmittance and reflection of the incident electromagnetic wave. This conventional technology is disclosed in, for example, the Electrical Communication Society Report, Vol. 50, No. 3 (March 1967), pp 416–423. Namely, the electrical field vector $\vec{E}$ of an incident electromagnetic wave is needed to align in parallel to the electroconductive films in order to be absorbed. In the conventional structure, the electroconductive film elements are arranged in parallel crosses so that all of the horizontal and vertical vector components of the electromagnetic wave can align in parallel to the electroconductive films.

Further, recently it is theoretically suggested that an absorbing body having a varying absolute value $|\epsilon|$ of complex permittivity varying gradually along the advancing direction of an incident electromagnetic wave can absorb the electromagnetic wave to suppress the reflection thereof. However, it is difficult to arrange the permittivity $\epsilon$ to gradually change. Therefore, it is practically proposed to stack a plurality of absorbing body segments having different permittivities on a wall so as to change the permittivity discretely and step wisely along the incident wave.

Further, it is known that a plurality of pyramid bodies each composed of plastic foam containing a considerable amount of electroconductive carbon black are arranged such that the top vertexes of the pyramids are directed toward the incident electromagnetic wave so that the surface electric resistivity of the bodies can be gradually changed as a whole structure along the incident wave direction.

In the second-mentioned conventional structure in which absorbing body segments of different permittivities are stacked on a wall, the permittivity cannot be gradually changed, thereby failing to effectively suppress the reflection of the incident wave. Moreover, such structure has practical problems that the stacked body segments have a considerably heavy total weight, and manufacturing thereof requires a considerable burden.

In the third-mentioned conventional structure comprised of pyramid plastic-mold bodies containing carbon black, a great content of carbon black is needed to increase the absorption efficiency, resulting in increase of the body weight. Further, due to the moisture absorbing capacity of the carbon black, air conditioning equipment is needed to avoid the deterioration of electromagnetic wave absorption property.

SUMMARY OF THE INVENTION

In order to solve the above-mentioned problems of the prior art, an object of the present invention is to construct a three-dimensional electromagnetic wave absorbing element comprised of a three-dimensionally formed dielectric substrate, and an electroconductive film formed on the substrate and having a gradually changing surface resistivity. Another object of the present invention is to form the electroconductive film into a reticulate pattern such that the width of individual reticulate pattern lines is gradually varied to change the surface resistivity so as to provide the electromagnetic wave absorbing element of three-dimensional structure.

In use, a plurality of the inventive elements are arranged along a desired wall. The electroconductive film is disposed in parallel to the advancing direction of an incident electromagnetic wave such that the surface resistivity of the film is gradually decreased in the wave advancing direction. As mentioned before, the electric field component $\vec{E}$ of the wave is needed to align in parallel to the electroconductive film. In this regard, the absorbing elements are arranged in rows-and-columns on the wall so that the electrical field component $\vec{E}$ can align in parallel to the electroconductive film which is disposed on vertical peripheral side surfaces of each individual element when the incident wave is irradiated normal to the wall. If the incident wave is irradiated obliquely relative to the wall, the vertical component $\vec{S}(X)$ of pointing vectors $\vec{S}$ of the incident wave is selectively absorbed with leaving the other components $\vec{S}(Y)$ and $\vec{S}(Z)$ which are parallel to the wall and therefore do not cause the reflection of incident wave.

DETAILED DESCRIPTION OF THE INVENTION

Figure 1C:
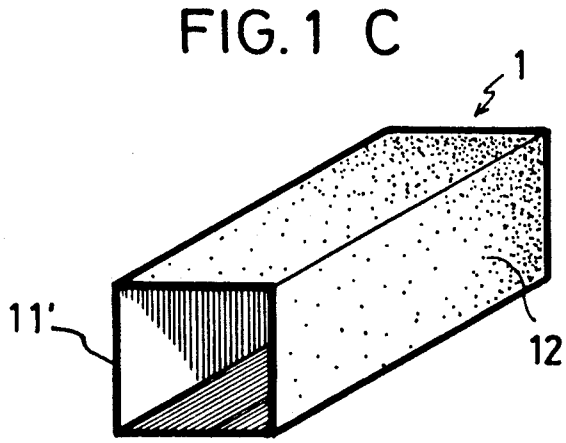
FIGS. 1A, 1B and 1C show perspective views of different embodiments of the inventive electromagnetic wave absorbing element.
Figure 2:
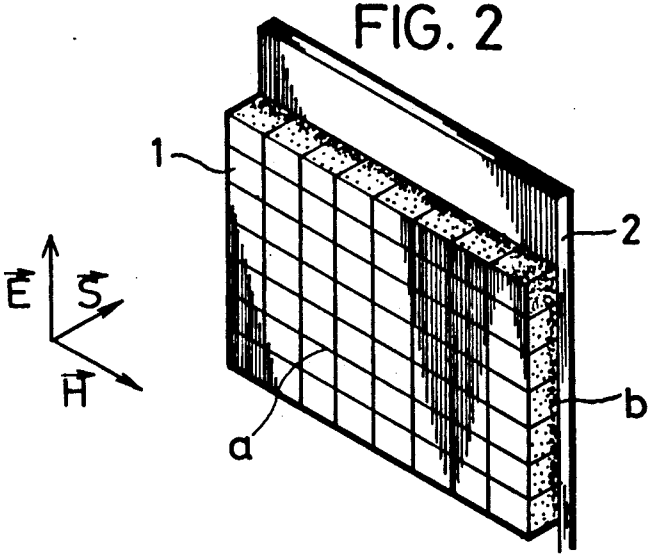
FIG. 2 shows a row-and-column arrangement of the inventive electromagnetic wave absorbing elements along a wall.
Figure 1A:
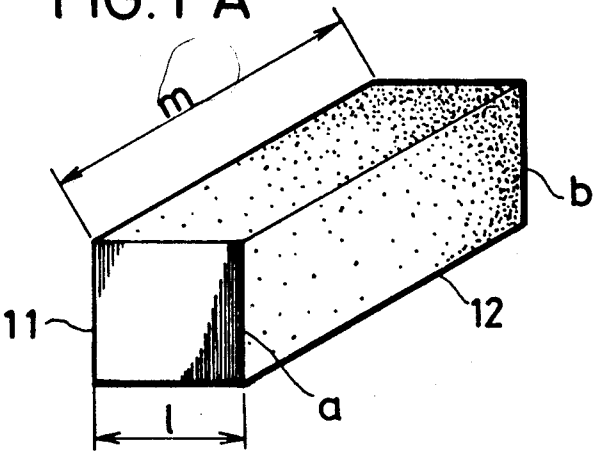
Figure 1B:
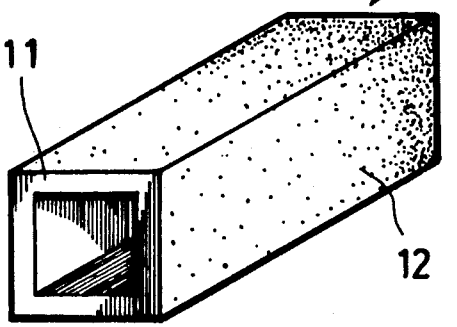

The present invention will be explained in detail in conjunction with the drawings in which FIGS. 1A, 1B and 1C show different embodiments of the inventive absorbing element, and FIG. 2 shows an arrangement of the inventive elements along a wall in use.

As shown in FIG. 1A, the absorbing element 1 is comprised of an elongated rectangular body 11 composed of plastic mold, and an electroconductive film 12 formed on the peripheral side surfaces of the body 11 which are vertical to the bottom surface of the body 11. In FIG. 1B, the absorbing element 1 is comprised of a tubular mold body 11 having a rectangular cross section, and an electroconductive film 12 formed on the peripheral side surfaces of the tubular body. In FIG. 1C, the absorbing element 1 is comprised of a frame body 11' 15 composed of are rectangularly folded plastic sheet, and an electroconductive film 12 formed on the folded plastic sheet.

The body includes a substrate portion for supporting thereon the electroconductive film and being composed of dielectric or electrically insulating material. For example, the substrate portion is composed of plastic film, plastic sheet, paper sheet, cloth sheet, non-woven fabric sheet, plastic foam mold, plastic solid mold, and wood block.

In the embodiments of FIGS. 1A and 1B, the substrate portion is comprised of a peripheral surface portion or the side wall of the mold body 11, or a dielectric sheet adhered to the peripheral surface of mold body 11 and extending continuously therearound to completely encircle the peripheral surface. In the embodiment of FIG. 1C, the substrate portion is the plastic sheet 11' itself.

The electroconductive film 12 disposed on the peripheral surfaces of the body 11, 11' has a varying surface electroconductivity or a varying surface resistivity inverse to the surface electroconductivity. Preferably, the surface resistivity characteristic varies continuously exponentially along the direction X or the incident wave advancing direction. The reflection rate $d\Gamma$ of the absorbing element is proportional to $dZ/Z$ where Z is the characteristic impedance of the absorbing element. The impedance Z is generally proportional to the surface resistivity. Therefore, when the surface resistivity changes exponentially, the value of $d\Gamma$ is made constant along the direction X to thereby reduce the reflection rate as a total.

It should be noted that, in the specification, the term surface resistivity does not mean a surface resistivity of the electroconductive film itself, but means a surface resistivity per unit area (e.g., one inch square) of the body peripheral surface covered with the electroconductive film, obtained by measuring a surface resistance of a given area of the body peripheral surface and by converting the measured value into the surface resistivity.

In order to avoid reflection of the incident wave at the boundary between the surrounding air and the absorbing element, the characteristic impedance Z at the top portion $\bar{a}$ (FIG. 1A) of the element 1 through which the incident wave enters should be preferably close to the impedance of air. Practically, the surface resistivity at the top portion $\bar{a}$ is set to more than $10^3$ Ω.

In order to avoid reflection at the boundary between the bottom portion $\bar{b}$ (FIG. 1A) of the element 1 and the wall, the characteristic impedance Z at the bottom portion $\bar{b}$ should be close to that of the wall. In case of an electromagnetically dark room, the walls are normally made of metal plate so as to block an external electromagnetic wave, and therefore the characteristic impedance Z should be as small as possible. Practically, the surface resistivity may be set below 10 Ω, and optimumly below 1 Ω.

The electroconductive film 12 can be formed on the substrate portion by printing of electroconductive ink. The electroconductive ink is of, for example, usual type containing electroconductive filler such as electroconductive carbon black, metal powder, flake, fiber, copper iodide and metal-film-covered flake of fiber or mica.

The electromagnetic ink can be printed directly on the substrate portion by gravure printing or silk screen printing, or can be printed on a non-adhesive sheet and then transferred to the substrate portion by means of an adhesive agent.

Figure 4:
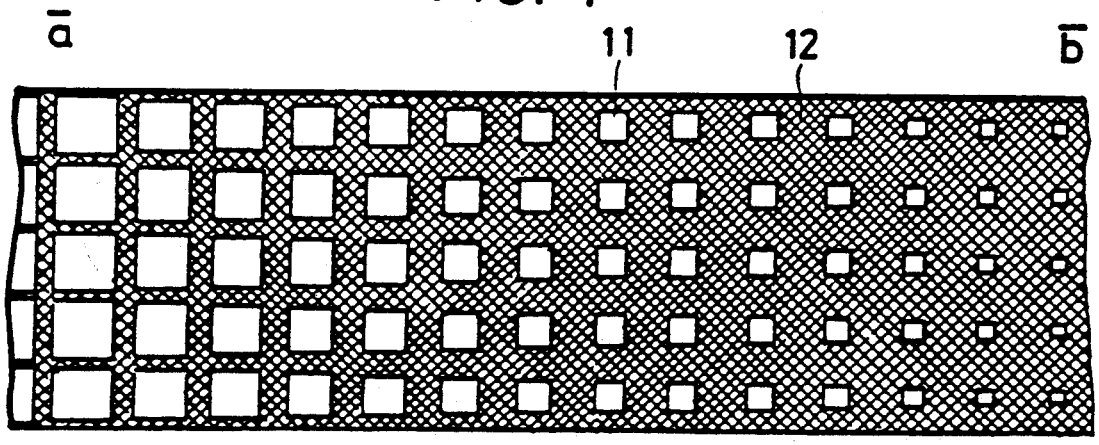
FIG. 4 is a plan view of the electroconductive film pattern.

In order to vary the surface resistivity, several methods are available as follows: (I) a method of repeatedly printing electroconductive ink layers in partially overlapping relation such that the overlapped ink layer has a relatively small surface resistivity and the non-overlapped ink layer has a relatively great surface resistivity; (II) a method of printing the electroconductive ink in a reticulate pattern as shown in FIG. 4 to form a mesh-like electroconductive film 12 in which the width of individual reticulate pattern lines are gradually changed; (III) a method of printing the electroconductive ink in a reticulate pattern to form a mesh-like film such that the width of individual reticulate pattern lines are increased toward the bottom portion of absorbing element; and (IV) a method of controlling the pattern depth of printing plate to gradually change the thickness of printed electroconductive film.

Table 1 shows surface resistivities of various electroconductive ink films printed by screen printing with different thickness, utilizing a copper powder ink (item number LS408 produced by ASAHI CHEMICAL RESERCH LAHOHATORY LTD, hereinafter ASAHI KAKEN K.K.), a carbon black ink (FT20S produced by ASAHI KAKEN K.K.), a mixture of the two inks at the ratio of 7:3, another mixture of the two inks at the ratio of 5:5 and other carbon black inks (FTU100 and FTU500 produced by ASAHI KAKEN K.K.), and utilizing a stainless screen plate of mesh 200 (ST200), a stainless screen plate of mesh 325 (ST325), and a Tetoron screen plate of mesh 200. In the Table, "printing number" means the repetition number of overlapping printing, the ink "7/3" means an ink mixture of the copper powder ink (LS408) and the carbon black ink (FT20S) at the ratio of 7:3, and the ink "5/5" means another ink mixture of the same inks at the ratio of 5:5.

TABLE 1

| Screen | Ink | Printing number | Thickness | Surface resistivity |
|---|---|---|---|---|
| ST200 | LS408 | 2 | 15 | 0.01 |
| T200 | 7/3 | 1 | 6 | 0.1 |
| T200 | 5/5 | 1 | | 1 |
| ST200 | FT20S | 2 | 16 | 10 |
| T200 | FT20S | 1 | 6 | 100 |
| T200 | FTU100 | 1 | 6 | 200 |
| T200 | FTU500 | 1 | 6 | 1000 |
| | | | (μ) | (Ω) |

In addition, when the carbon black ink (FTU100) is printed with the Tetoron screen plate of 250 mesh in a reticulate pattern with a surface cover rate of 20%, the printed substrate portion has a surface resistivity of 1500 Ω, and when the carbon black ink (FTU500) is printed in a with reticulate pattern with surface cover rate of 20%, the printed substrate portion has a surface resistivity of 9000 Ω.

The feature that the electroconductive films 12 are arranged three-dimensionally means that the films are not of two-dimension or not of a plane. In the embodiments of FIGS. 1A, 1B and 1C, the electroconductive film 12 is arranged on the peripheral side surfaces of the elongated rectangular body. The distance $\bar{l}$ between the opposed films must be smaller than the wavelength λ of the incident electromagnetic wave energy to be absorbed. If the distance $\bar{l}$ is greater than the wavelength λ, the incident electromagnetic wave energy cannot be sufficiently absorbed. For example, if the incident electromagnetic wave is a microwave of 1000 MHz (the wavelength is about 30 cm), the distance $\bar{l}$ should be smaller than 30 cm. However, it would be preferable to limit the wavelength of incident wave as ten times as the distance $\bar{l}$. The length $\bar{m}$ of the absorbing element should be relatively small. The length of 20 cm–60 cm is practical.

The electroconductive films 12 are arranged as described above according to the following methods. In the embodiments of FIGS. 1A and 1B, the films are direct-printed or transfer-printed on the peripheral side surfaces of the mold body 11, or the films are printed on a substrate plastic film which is attached to the peripheral side surfaces of the mold body by adhesive. In the embodiment of FIG. 1C, the electroconductive film is printed on a plastic sheet, and thereafter the plastic sheet is rectangularly folded to form the frame body 11'. In addition, the electroconductive film is not only arranged on the peripheral side surfaces of rectangular body, but also can be arranged on the side faces of a pyramid, cone, circular cylinder and hexagonal cylinder.

In use of the inventive absorbing elements, a plurality of the elements 1 are arranged on and fixed to the wall 2 in rows-and-columns as shown in FIG. 2. The wall 2 is provided on its major face with a metal plate. The wall 2 defines a plane incident to the electromagnetic wave energy, and the elements 1 are stacked one on top of the other along the plane to form an electromagnetic wave absorptive wall. When the incident electromagnetic wave enters in the direction indicated by the pointing vector $\bar{S}$, each individual element 1 is fixed to the wall 2 at its rear end portion $\bar{b}$ which has the smallest surface resistivity.

EXAMPLE

Figure 3:
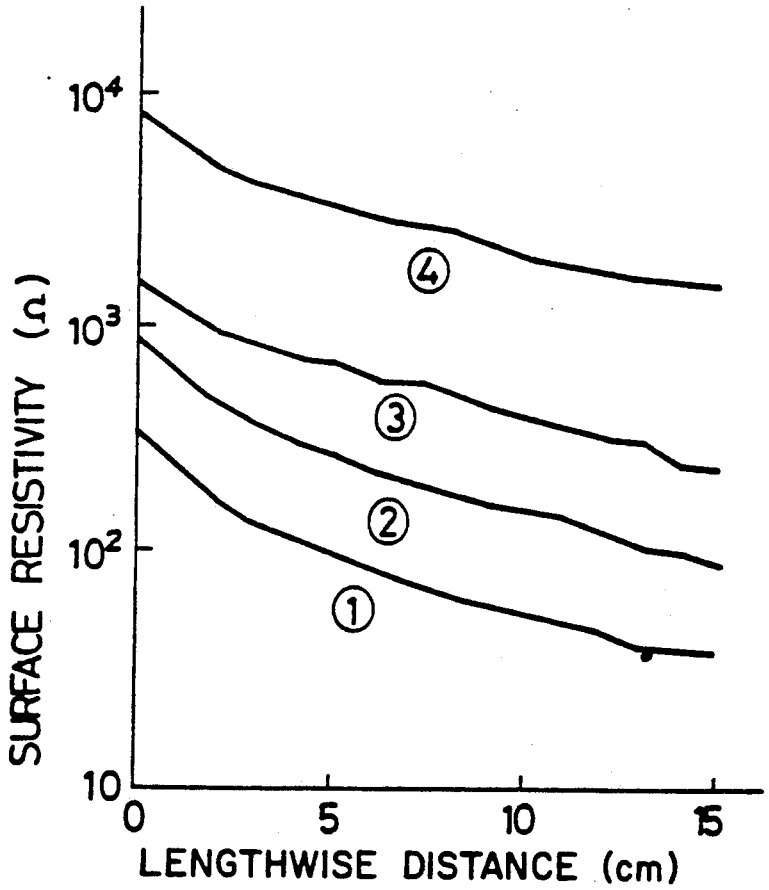
FIG. 3 is a diagram illustrating a distribution of surface electric resistivity of the electroconductive film utilized in the inventive electromagnetic wave absorbing element.

The carbon black inks (FT20S and FTU100) are printed on polyester films in reticulate patterns such that the width of individual pattern lines are gradually changed so as to prepare four kinds of films. Each film is attached by adhesive to the peripheral side faces of a cubic body having an edge of 15 cm and composed of styrol foam to thereby produce four kinds of the electroconductive absorbing elements ①, ②, ③ and ④. The lengthwise distribution of surface resistivity of the peripheral face of the respective four-kind absorbing elements is indicated in FIG. 3 in terms of the distance measured from the top end portion of the element through which the incident wave enters.

The measurement of reflection rate of the absorbing element is carried out as follows. Namely, a copper mesh having a mesh interval of 3 mm–4 mm is disclosed on the floor of an electromagnetically dark room. A pair of dipole antennas having a height of 1.5 m are disposed on the copper mesh in spaced relation at a distance 3 m so that one of the antennas functions as a transmitter and the other antenna functions as a receiver. A reflection plate is comprised of a copper-foil-laminated plate attached with a square frame having an edge of 60 cm.

The reflection plate is disposed behind the receiver, and the transmitter is oscillated to emit an electromagnetic wave of a specific frequency. The electric field intensity of the standing wave reflected by the reflection plate is measured by the receiver. During the measurement, the reflection plate is displaced to measure the minimum electric field intensity to determine the reference electric field intensity $E_0$.

Next, a set of the same kind electromagnetic wave absorbing elements are disposed within the frame of the reflection plate in rows-and-columns to constitute an absorbing panel. In similar manner, the electric field intensity of the standing wave is measured while displacing the absorbing panel to determine the minimum electric field intensity E'. In this state, the absorbed electric field intensity E absorbed by the absorbing panel is represented by the relation $E=E_0-E'$. The absorption rate is defined by $E/E_0$ in dB unit.

The absorption rates for the four kinds of absorbing elements ①, ②, ③ and ④ when using the electromagnetic wave of 300 MHz are indicated in Table 2. In Table 2, the element "1/2①" means that the electromagnetic wave absorbing panel contains within the frame the absorbing elements ① and plastic foam mold bodies attached with no electroconductive film, arranged in rows-and-columns in staggered relation to each other.

TABLE 2

| absorbing element | absorption rate (dB) |
|---|---|
| ① | 6 |
| ½① | 10 |
| ② | 7 |
| ③ | 2 |
| ④ | 3 |

Next, the absorption rate of the absorbing element ② is indicated in Table 3 when using electromagnetic waves of 600 MHz and 1000 MHz.

TABLE 3

| frequency | absorption rate (dB) |
|---|---|
| 600 MHz | 15 |
| 1000 MHz | 21 |

As described above, according to the present invention, the electromagnetic wave absorbing element is produced by printing, and a light weight material can be utilized as a body of the element. Therefore, an electromagnetically dark room can be easily constructed at a considerably low cost, and is not affected by

What is claimed is:

1. An element for absorbing an electromagnetic wave and stackable with elements of like configuration along a given plane to form an electromagnetic wave absorptive wall, comprising: a three-dimensional mold body having thereon a dielectric substrate portion comprised of a dielectric sheet attached to a face of the three-dimensional mold body, the dielectric sheet being coterminous with the face of the mold body and not extending beyond the boundaries of the mold body to enable individual elements to be stacked one atop the other through adjacent dielectric sheets of the stacked elements along a given plane; and an electroconductive film deposited on the dielectric substrate portion and having gradually changing surface resistively effective to absorb electromagnetic wave incident toward the given plane.

2. An element according to claim 1; wherein the three-dimensional mold body has a bottom portion attachable to an external wall, and a peripheral face extending three-dimensionally from the bottom portion to define the substrate portion.

3. An element according to claim 2; wherein the three-dimensional mold body has a peripheral face extending vertically from the bottom portion.

4. An element according to claim 3; wherein the three-dimensional mold body comprises an elongated rectangular mold body having elongated peripheral faces.

5. An element according to claim 3; wherein the three-dimensional mold body comprises a rectangular tubular mold body having a rectangular cross section of the bottom portion.

6. An element according to claim 2; wherein the electroconductive film formed on the peripheral face has a surface resistivity gradually decreasing toward the bottom portion.

7. An element according to claim 6; wherein the electroconductive film has a surface resistivity decreasing exponentially toward the bottom portion.

8. An element according to claim 1; wherein the electroconductive film is composed of electroconductive printing ink film printed on the substrate portion.

9. An element according to claim 8; wherein the electroconductive printing ink film has a reticulate pattern containing individual pattern lines having gradually changing widths.

10. An element for absorbing incident electromagnetic wave energy and stackable with elements of like configuration along a given plane to form an electromagnetic wave absorptive wall, comprising: a three-dimensional body having top and bottom ends interconnected by a peripheral side wall; a dielectric sheet superposed over and attached to the body side wall and extending continuously around the entire peripheral side wall of the body to completely encircle the body side wall to enable individual elements to be stacked one atop the other through adjacent dielectric sheets of the stacked elements along a given plane; and an electroconductive film deposited on the dielectric sheet, the electroconductive film having a surface resistivity characteristic which decreases in a direction from the body top end to the body bottom end, the surface resistivity characteristic being effective to absorb incident electromagnetic wave energy advancing toward the given plane in the direction from the body top end to the body bottom end.

11. An element according to claim 10; wherein the surface resistivity characteristic gradually decreases in the direction from the body top end to the body bottom end.

12. An element according to claim 10; wherein the surface resistivity decreases exponentially in the direction from the body top end to the body bottom end.

13. An element according to claim 10; wherein the electroconductive film comprises and electroconductive printed ink film.

14. An element according to claim 13; wherein the printed ink film comprises partly overlapped printed ink film layers.

15. An element according to claim 13; wherein the printed ink film comprises a printed ink film reticulate pattern.

16. An element according to claim 10; wherein the electroconductive film comprises partly overlapped electroconductive film layers.

17. An element according to claim 10; wherein the electroconductive film comprises a reticulate film pattern.

* * * * *